US011257470B1

(12) United States Patent
Fry

(10) Patent No.: US 11,257,470 B1
(45) Date of Patent: Feb. 22, 2022

(54) STRING INSTRUMENT WITH SUPERIOR TONAL QUALITIES

(71) Applicant: Alvin Fry, Gray Summit, MO (US)

(72) Inventor: Alvin Fry, Gray Summit, MO (US)

( * ) Notice: Subject to any disclaimer, the term of this patent is extended or adjusted under 35 U.S.C. 154(b) by 0 days.

(21) Appl. No.: 17/062,205

(22) Filed: Oct. 2, 2020

(51) Int. Cl.

| | |
|---|---|
| ***G10D 3/02*** | (2006.01) |
| ***G10D 1/02*** | (2006.01) |
| ***G10D 3/22*** | (2020.01) |
| ***G10D 3/06*** | (2020.01) |
| ***G10D 3/13*** | (2020.01) |
| ***G10D 3/04*** | (2020.01) |

(52) U.S. Cl.
CPC ..... *G10D 3/02* (2013.01); *G10D 1/02* (2013.01); *G10D 3/04* (2013.01); *G10D 3/06* (2013.01); *G10D 3/13* (2020.02); *G10D 3/22* (2020.02)

(58) Field of Classification Search
CPC .. G10D 3/02; G10D 3/13; G10D 3/22; G10D 1/02; G10D 3/04; G10D 3/06
See application file for complete search history.

(56) References Cited

U.S. PATENT DOCUMENTS 1,819,796 A * 8/1931 Sherman ..... G10D 3/02 84/276
3,014,394 A * 12/1961 Szymanski ..... G10D 3/02 84/276
3,136,196 A * 6/1964 Charlesworth ..... G10D 3/02 84/275
3,494,239 A * 2/1970 Michael ..... G10D 3/02 84/276
3,603,193 A * 9/1971 Archibald ..... G10D 3/04 84/309
4,061,068 A * 12/1977 Stetson ..... G10D 3/02 84/275
4,325,279 A * 4/1982 Lower ..... G10D 3/02 84/275
4,372,189 A * 2/1983 Johnson ..... G10D 3/02 84/276
4,838,140 A * 6/1989 Meissner ..... G10D 1/02 84/275
5,325,756 A * 7/1994 Sugden ..... G10D 3/02 84/277
5,381,714 A * 1/1995 Kasha ..... G10D 3/02 84/275
5,396,822 A * 3/1995 Itokawa ..... G10D 3/02 84/276
5,841,047 A * 11/1998 Mandreck ..... G10D 1/02 84/274
7,282,630 B2 * 10/2007 Van Vliet ..... G10C 9/00 84/291
7,678,979 B1 * 3/2010 Roop ..... G10D 3/02 84/309
7,820,896 B2 * 10/2010 Wang ..... G10D 3/02 84/276
8,217,254 B2 * 7/2012 Zoran ..... G10D 1/085 84/743

(Continued)

*Primary Examiner* — Robert W Horn
(74) *Attorney, Agent, or Firm* — Workman Nydegger

(57) ABSTRACT

A string instrument is disclosed having a body with an air cavity defined by a top plate, a bottom plate, and one or more ribs, a bass bar being secured to an inside surface of the top plate, the bass bar comprising a layup of a plurality of laminates constructed from western red cedar and comprising particular dimensions and placement on the top plate relative to the length of the instrument body.

17 Claims, 4 Drawing Sheets

(56) References Cited

U.S. PATENT DOCUMENTS

| | | | | |
|---|---|---|---|---|
| 8,378,191 | B2 * | 2/2013 | Barillaro | G10D 3/02 84/267 |
| 8,729,371 | B2 * | 5/2014 | Yokoyama | B22F 10/20 84/173 |
| 10,199,016 | B2 * | 2/2019 | Hellinge | G10D 3/12 |
| 2004/0129127 | A1 * | 7/2004 | Mercer | G10D 3/04 84/307 |
| 2012/0085217 | A1 * | 4/2012 | Threlkeld-Wiegand | G10D 3/02 84/276 |

* cited by examiner

STRING INSTRUMENT WITH SUPERIOR TONAL QUALITIES

BACKGROUND

Technical Field

This disclosure generally relates to musical instruments. More specifically, the present disclosure relates to string instruments with superior tonal qualities.

Related Technology

Classical string instruments, such as violins, violas, cellos, and basses have been produced by artisan craftsmen for centuries. The sound produced by string instruments is a result of the interactions between each instrument's various parts. When a string of the instrument vibrates, that vibration resonates through the bridge and sound post, passing into the hollow body of the instrument to allow the sound to resonate into the surrounding air. The quality of such sound depends significantly on the tension produced by the various parts of the string instrument. Some string instruments are unable to produce a smooth, vibrant sound due to poor construction or design of the various components of the instrument.

Artisan-crafted classical string instruments are well known for their superior sound quality because each instrument is meticulously crafted to ensure a construction capable of producing a balanced and robust tonal spectrum. Variations in the construction of each instrument have traditionally been necessary to ensure the ideal tension is produced by the completed violin in order to achieve a robust, clear, and powerful tone. Production of classical string instruments with optimum tonal qualities, therefore, has generally proven to be difficult, laborious, and expensive.

Accordingly, there are a number of disadvantages with classical string instruments that can be addressed.

BRIEF SUMMARY

Implementations of the present disclosure solve one or more of the foregoing or other problems in the art with string instruments having superior tonal qualities. In particular, one or more implementations can include a string instrument is disclosed having a body with an air cavity defined by a top plate, a bottom plate, and one or more ribs, a bass bar being secured to an inside surface of the top plate, the bass bar comprising a layup of a plurality of laminates constructed from western red cedar and comprising particular dimensions and placement on the top plate relative to the length of the instrument body.

String instruments with superior tonal qualities of the present disclosure can also include a bass bar having a length such that the ratio of the length of the bass bar to the length of the string instrument body is approximately four to seven. Some string instruments of the present disclosure comprise a bass bar being secured to an inside surface of a top plate of the string instrument, wherein a first end of the bass bar is proximate a central longitudinal axis of the top plate at a distance from a top end of the top plate such that the ratio of the distance to the length of the instrument body is approximately three to fourteen, and wherein the bass bar extends from the first end at a particular angle relative to the central longitudinal axis of the top plate.

Accordingly, a string instrument with superior tonal qualities is disclosed.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope.

The disclosure will be described and explained with additional specificity and detail through the use of the accompanying drawings in which.

DETAILED DESCRIPTION

Figure 1:
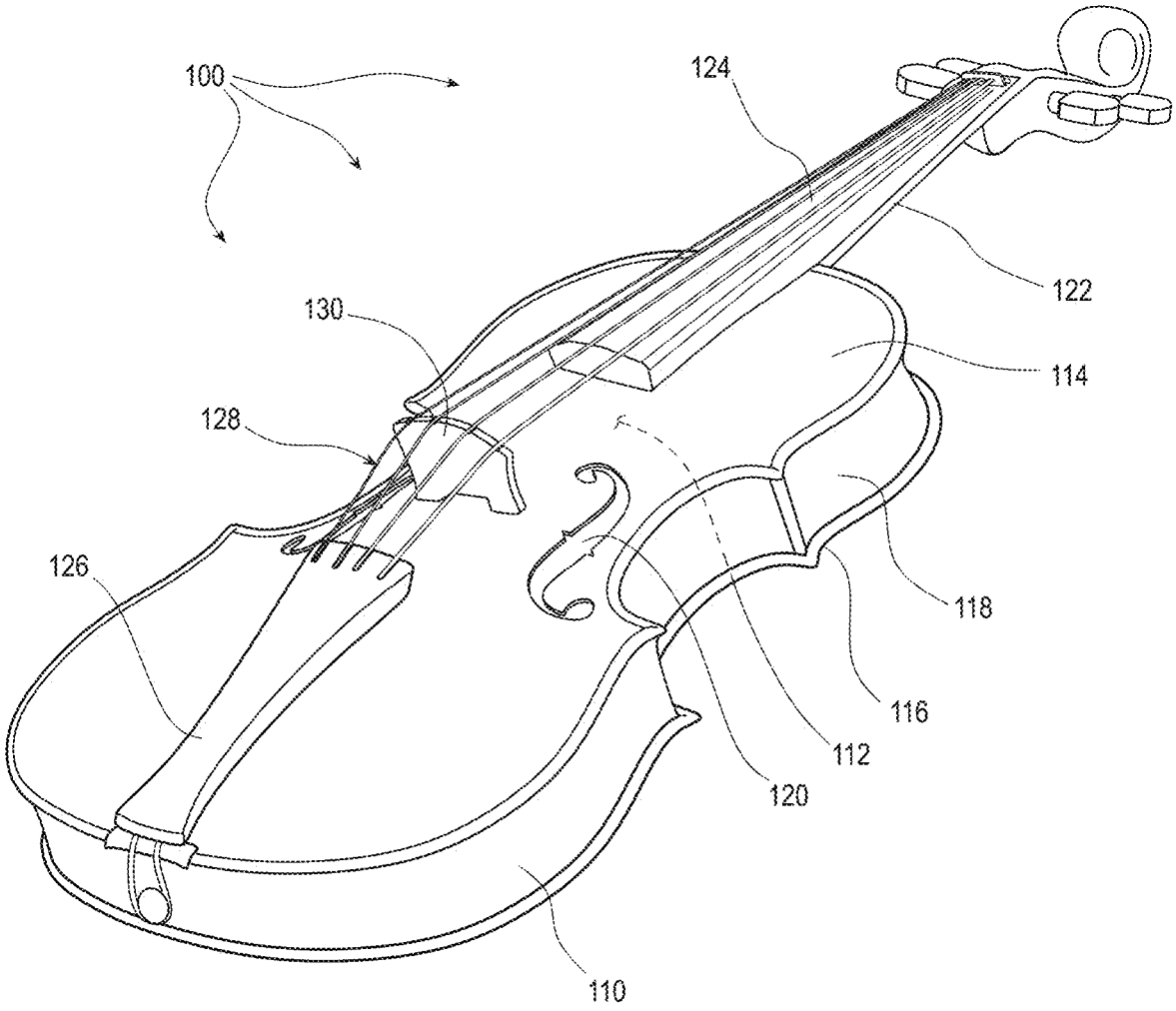
FIG. 1 illustrates a perspective view of a string instrument with superior tonal qualities according to one or more embodiments of the present disclosure.

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments and is not necessarily intended to limit the scope of the claimed invention.

In addition, unless otherwise indicated, numbers expressing quantities, constituents, distances, or other measurements used in the specification and claims are to be understood as being modified by the term "about," as that term is defined herein. Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

The terms "approximately," "about," and "substantially" as used herein represent an amount or condition close to the stated amount or condition that still performs a desired function or achieves a desired result. For example, the terms "approximately," "about," and "substantially" may refer to an amount or condition that deviates by less than 10%, or by less than 5%, or by less than 1%, or by less than 0.1%, or by less than 0.01% from a stated amount or condition.

Unless defined otherwise, all technical and scientific terms used herein have the same meaning as commonly understood by one of ordinary skill in the art to which the present disclosure pertains.

Embodiments of the present disclosure enable a maker of string instruments or luthier to consistently construct string instruments capable of producing sound with superior tonal qualities. For example, string instruments of the present disclosure exhibit improvements over currently available string instruments in terms of power, playability, tonal balance, dynamic range, vibrato, intonation of double-stopped fifths, and various other aspects generally sought after by musicians and players of string instruments. Further, string instruments according to the present disclosure exhibit the power, range, and balance necessary to be played alongside a grand piano, with the lid of the piano fully raised, without being overpowered or muted by the sound of the grand piano. Further still, while some presently available string instruments are indeed capable of exceptional tonal qualities in the hands of a highly trained musician exhibiting exceptional finesse and skill, string instruments of the present disclosure are capable of producing superior tonal qualities with relative ease by musicians of moderate skill.

Moreover, string instruments according to the present disclosure can be played gently with finesse or more aggressively while producing the superior tonal qualities with either style of playing. The design and construction of previously available string instruments did not produce superior tonal qualities when played in both styles (gentle/finesse vs. aggressive). At best, previously available string instruments would produce superior tonal qualities only when played in one style or the other, but not both. For instance, many Stradivarius violins have to be played more gently or with more finesse in order to produce high quality sounds. If such instruments are played more aggressively, the quality of the produced sounds diminished dramatically. In contrast, other types of previously produced violins could produce high quality sound when played more aggressively, but not when played gently or with finesse. Thus, the string instruments of the present disclosure allow for a player to employ whichever style he/she desires or is required for a particular piece of music, while still producing superior tonal qualities that are not diminished by playing in one style or the other.

In particular, the methods, materials, and construction of various components of string instruments with superior tonal qualities are disclosed.

Embodiments of the present disclosure include string instruments having a body with an air cavity defined by a top plate, a bottom plate, and one or more ribs, a bass bar being secured to an inside surface of the top plate, the bass bar comprising a layup of a plurality of laminates constructed from western red cedar and comprising particular dimensions and placement on the top plate relative to the length of the instrument body.

Embodiments disclosed herein include multiple ratios that can be applied to string instruments of various dimensions and sizes to improve the tonal qualities and other qualities of each string instrument. In some embodiments, for example, a violin of classical dimensions and construction is improved by the incorporation of a bass bar that is constructed and installed according to the present disclosure. Some embodiments comprise differing sizes of violins, such as but not limited to 1/4, 2/4, 3/4, and 4/4, as well as all sizes of violas, cellos, basses, and other string instrument designs. One should appreciate that the present disclosure may be applied to any string instrument design to achieve superior tonal qualities.

While the drawings accompanying this disclosure focus in part on a violin for convenience and consistency, the disclosed materials, constructions, ratios, and dimensions can be applied to different string instruments without a loss of tonal qualities.

Referring to FIG. 1, some embodiments of a string instrument 100 comprise a body 110 having an air cavity 112, body 110 being formed by a top plate 114 and a back plate 116 being secured to one or more ribs 118 to form air cavity 112 therebetween. As illustrated, one or more f-holes 120 are cut into top plate 114 of some embodiments, thus creating an opening through which sound may pass from within air cavity 112. Additionally, some embodiments include a neck 122 attached to and extending away from an upper end of body 110, neck 122 having a fingerboard 124 thereon or attached thereto, as well as a tailpiece 126 attached to a lower end of body 110 and a plurality of strings 128 coupled between tailpiece 126 and a distal end of neck 122. Also as illustrated, some embodiments include a bridge 130 associated with top plate 114 proximate f-holes 120 and configured to support strings 128 above fingerboard 124.

Figure 2A:
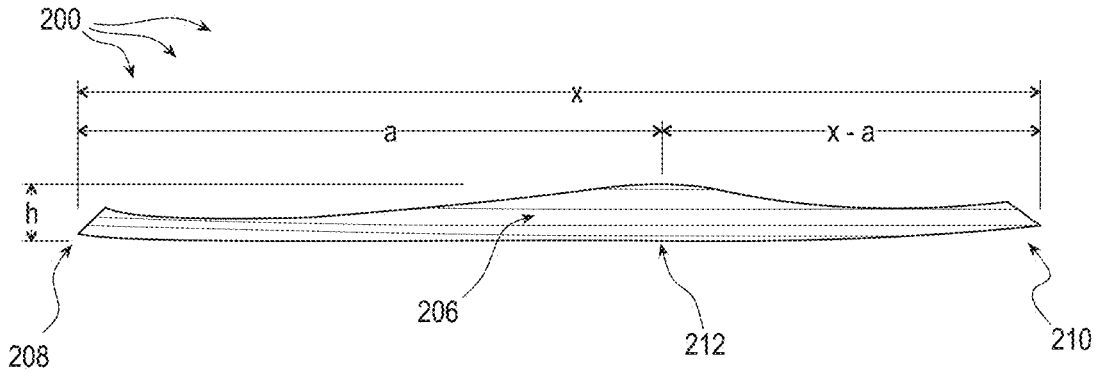
FIG. 2A illustrates a side view of a bass bar according to one or more embodiments of the present disclosure.
Figure 2B:
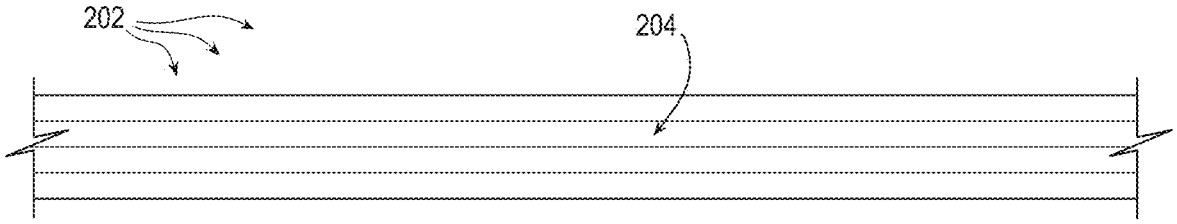
FIG. 2B illustrates a bottom view of a layup of laminates from which the bass bar of FIG. 2A is produced according to one or more embodiments of the present disclosure.
Figure 2C:
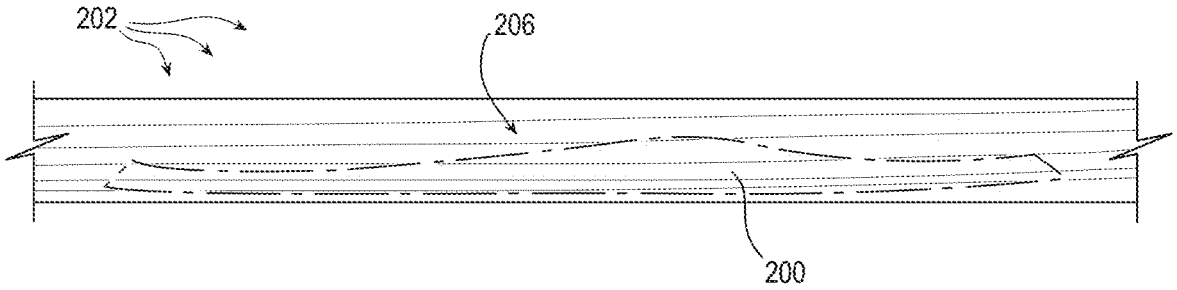
FIG. 2C illustrates a side view of the layup of laminates of FIG. 2B.

As illustrated in FIGS. 2A through 2C, some embodiments of the present disclosure include a bass bar 200 comprising particular dimensions relative to the size of the string instrument to which bass bar 200 is to be secured. For example, as shown in FIG. 2A, bass bar 200 has a length (x) between a first end 208 and a second end 210, and a height profile wherein the maximum height of bass bar 200 occurs at a particular distance (a) from a first end 208, and wherein the height of bass bar 200 gradually reduces along the length of bass bar 200 in either direction along its length to reach an minimum height at respective first end 208 and second end 210. In other words, bass bar 200 has a minimum height at first end 208, a height at second end 210 that is substantially equal to that of first end 208, and a maximum height at a point along the length of bass bar 200 at distance (a) from first end 208. In some embodiments, the ratio of distance (a) to the length (x) of bass bar 200 is approximately five to eight.

In some embodiments, the minimum thickness of bass bar 200 is approximately ¼ inch and the maximum thickness is approximately ½ inch. As further discussed in relation to FIG. 3 below, one or more embodiments of a string instrument having a 14-inch body according to the present disclosure comprise a bass bar 200 having a length (x) of approximately 8 inches, and a maximum thickness located a distance (a) approximately 5 inches from first end 208.

Also shown in FIG. 2A, some embodiments comprise a bass bar 200 that is cut from a wooden material such that the grain direction 206 is substantially parallel to the length (x) or longitudinal axis of bass bar 200. Also, some embodiments include chamfered edges at first end 208 and second end 210, as well as a tapered height profile from the minimum height at first end 208 to the maximum height (h) at distance (a) from first end 208 to the minimum height again at second end 210. Further, some embodiments comprise a lower edge 212 that is configured to conform with an inner surface of top plate 114 (see FIGS. 1 and 3).

In some embodiments, the ratio of maximum height (h) to length (x) is approximately three to sixty-four, the ratio of the height proximate to first end 208 to the maximum height (h) is approximately one to two, the height proximate to second end 208 is approximately equal to the height proximate to second end 210, and the ratio of a width of the bass bar to the length (x) is approximately one to thirty-two. In at least one embodiment, for example, bass bar 200 is sanded to a width of approximately ¼ inch, a height of approximately 3/16 inch at the first end and the second end, and a maximum height (h) of ⅜ inch.

FIG. 2B illustrates a bottom view of a layup 202 of multiple laminates 204 from which some embodiments of bass bar 200 is cut. In particular, some embodiments comprise layup 202 prepared from a plurality of laminates 204 pressed together with a layer of adhesive, each laminate 204 cut from western red cedar, such that the grain direction runs substantially parallel to the longitudinal axis of each laminate 204. In some embodiments, western red cedar split rails or posts are used for their consistent grain direction 206 as a result of the process by which the split rails and posts are cut from western red cedar trees; however, any timber, lumber, log or the like of western red cedar exhibiting a substantially consistent grain direction may be used to produce components of the present disclosure.

Each of the plurality of laminates 204 undergo a minimal sanding to ensure a smooth surface, then they are secured to one another with adhesive and pressed together to form layup 202. As depicted in FIG. 2B, some embodiments consist of four laminates 204; however, other embodiments are comprised of more or less than four laminates 204, depending on the desired overall thickness and strength of layup 202. In some embodiments, each laminate 204 is cut to a length approximately two inches greater than length (x) of bass bar 200 (see FIG. 2A), such that an embodiment wherein bass bar 200 is 8 inches long results in laminates 204 of approximately 10 inches in length. Also, some embodiments comprise laminates 204 having a thickness of approximately 1.5 millimeters and a width of approximately one inch. In some embodiments, laminates 204 have a thickness of approximately 0.075 inch.

FIG. 2C illustrates a side view of layup 202 from which bass bar 200 is cut according to some embodiments. As illustrated, the grain direction 206 is substantially parallel to the length or longitudinal axis of layup 202, as well as bass bar 200, resulting in optimum tensile strength of bass bar 200. Further, layup 202 of multiple laminates 204 exhibits a significant increase in tensile strength in comparison to traditional bass bar constructions using a single piece of material, thus allowing for the design of a bass bar 200 that is relatively shorter while simultaneously increasing the overall tension of the string instrument, which in turn improves the tonal qualities of the finished instrument.

As indicated by the broken lines in FIG. 2C, bass bar 200 is cut from layup 202. The lower edge 212 is configured to conform with an inner surface of top plate 114 by use of a contour gauge or similar tool to match lower edge 212 to the corresponding surface. Once bass bar 200 is cut from layup 202, it is sanded and shaped prior to installation. In some embodiments, the profile of bass bar 200 is cut from layup 202 with enlarged dimensions to allow for material to be removed in the sanding process in order to achieve the dimensions as discussed in relation to FIG. 2A.

Figure 3:
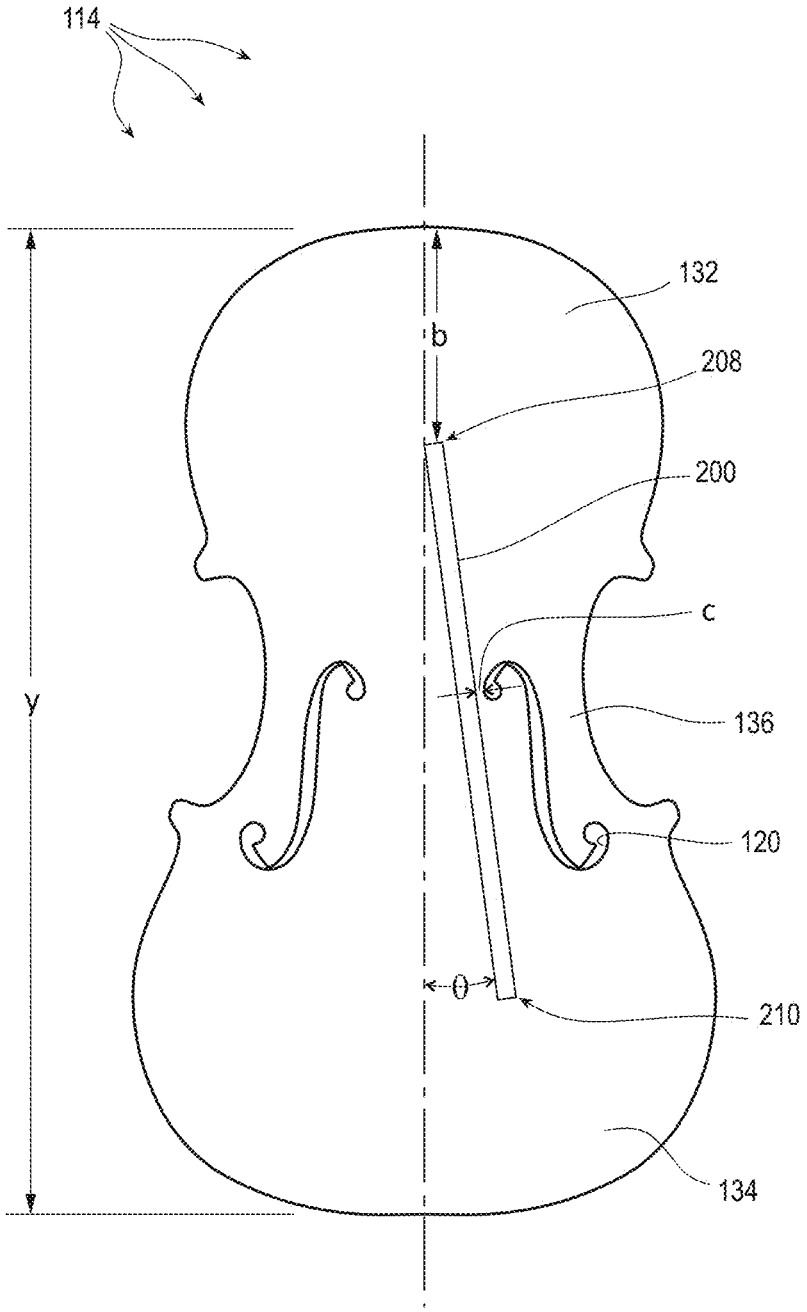
FIG. 3 illustrates a bottom view of a top plate with a bass bar according to one or more embodiments of the present disclosure.

As illustrated in FIG. 3, some embodiments of a top plate 114 comprise an upper bout 132, a lower bout 134, a waist 136, and two f-holes 120 defined by f-shaped cuts in top plate 114. As shown, top plate 114 has a length (y), which varies depending on the style and size of string instrument. As a non-limiting example, a full-size violin has a top plate 114 with a length (y) of approximately 14 inches. In some embodiments, the ratio of the length (y) of top plate 114 or body 110 to the length (x) of bass bar 200 (see FIG. 2A) is approximately four to seven. Accordingly, the length (x) of bass bar 200 can be calculated by multiplying the length (y) by 4/7.

FIG. 3 also illustrates the placement of bass bar 200 on the back side of top plate 114 according to some embodiments. As illustrated, bass bar 200 is secured to top plate 114 such that first end 208 is proximate a central longitudinal axis of top plate 114 and at a distance (b) from an upper end of top plate 114. In some embodiments, bass bar 200 extends from first end 208 towards second end 210 at an angle (θ) relative to the central longitudinal axis of top plate 114, such that bass bar 200 is separated from one of f-holes 120 by a distance (c). In some embodiments, the ratio of distance (b) to length (y) is approximately three to fourteen. Also, in some embodiments, the ratio of distance (c) to length (x) of bass bar 200 (see FIG. 2A) is approximately one to sixty-four. In some embodiments, bass bar 200 is also separated from a lower end of top plate 114 by a distance approximately equal to distance (b).

As a non-limiting example, a violin having a length (y) of 14 inches, in some embodiments, comprises a bass bar 200 having a length (x) equal to approximately 8 inches, the bass bar 200 being secured to top plate 114 at a distance (b) from an upper end of top plate 114 of approximately 3 inches and a distance (c) from one of f-holes 120 of approximately ⅛ inch. One should appreciate that string instruments having different values of length (y) would result in different values of length (x), distance (b), and distance (c), according to embodiments of the present disclosure.

Figure 4A:
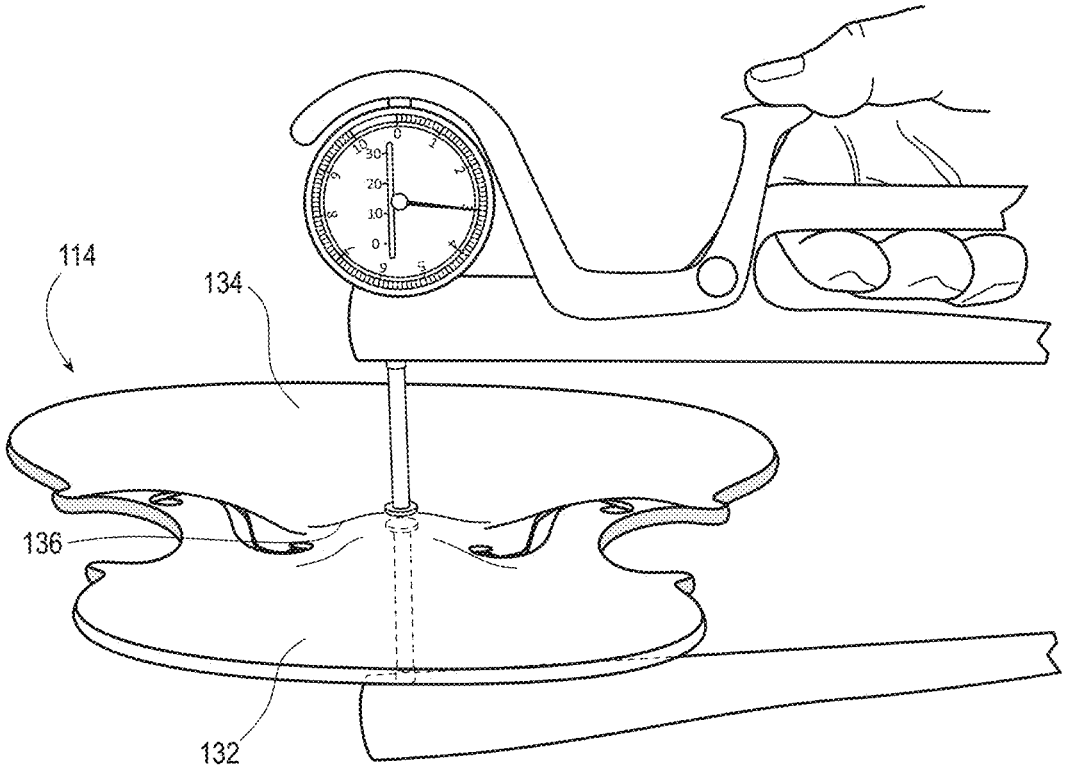
FIG. 4A illustrates a perspective view of a top plate according to one or more embodiments of the present disclosure.
Figure 4B:
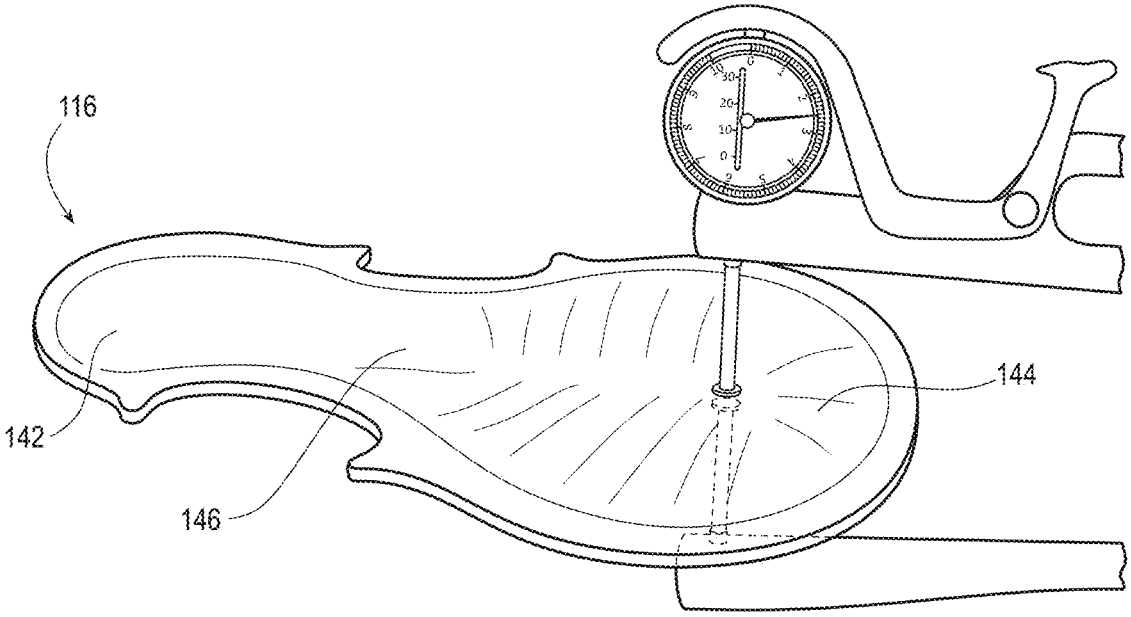
FIG. 4B illustrates a perspective view of a bottom plate according to one or more embodiments of the present disclosure.

Referring to FIGS. 4A and 4B, a top plate 114 and a back plate 116 according to some embodiments are illustrated with exemplary tools for measuring thickness. As shown in FIG. 4A, some embodiments include a top plate 114 having an upper bout 132, a lower bout 134, and a waist 136. In some embodiments, such as but not limited to a full-size violin, upper bout 132 has a thickness of approximately 2.0 to 2.5 millimeters, lower bout 134 has a thickness of approximately 2.0 to 2.5 millimeters, and waist 136 has a thickness of approximately 3.0 to 3.5 millimeters. One should appreciate that the disclosed thicknesses and other disclosed dimensions herein may be modified to correspond to different sizes of string instruments.

As shown in FIG. 4B, some embodiments include a back plate 116 having an upper bout 142, a lower bout 144, and a waist 146. In some embodiments, such as but not limited to a full-size violin, upper bout 142 has a thickness of approximately 2.0 to 2.5 millimeters, lower bout 144 has a thickness of approximately 2.0 to 2.5 millimeters, and waist 146 has a thickness of approximately 3.0 to 3.5 millimeters. One should appreciate that the disclosed thicknesses and other disclosed dimensions herein may be modified to correspond to different sizes of string instruments.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A string instrument with superior tonal qualities, comprising:

a body having an air cavity defined by a top plate and a back plate, each secured to one or more ribs, the top plate and the back plate being separated from one another by the one or more ribs;

two f-holes defined by f-shaped cuts in the top plate;

a neck attached to an upper end of the body, the neck extending away from the body and having a fingerboard thereon;

a tailpiece attached to a lower end of the body;

a plurality of strings coupled between the tailpiece and a distal end of the neck;

a bridge attached to the top plate between the two f-holes, the bridge configured to support the plurality of strings above the fingerboard; and a bass bar secured to a back side of the top plate, the bass bar comprising a plurality of laminates secured to one another in a single layup then cut to form the bass bar, the plurality of laminates being cut from western red cedar, such that each laminate has a grain direction substantially parallel to a longitudinal axis of the single layup, each laminate of the plurality of laminates having a thickness of approximately 0.075 inch, a width of approximately one inch, and a length of approximately 10 inches.

2. The string instrument as in claim 1, further comprising a sound post secured between the top plate and the back plate, wherein the sound post is constructed of western red cedar.

3. The string instrument as in claim 1, wherein the bass bar has a length (x) and the body has a length (y), such that the ratio of the length (x) of the bass bar to the length (y) of the body is approximately four to seven.

4. The string instrument as in claim 3, wherein the bass bar further comprises:

a chamfered first end, the bass bar having a first height proximate the chamfered first end;

a chamfered second end opposite the first end along the length (x), the bass bar having a second height proximate the chamfered second end;

a tapered height profile along the length (x), wherein the bass bar has a maximum height (h) at a distance (a) from the chamfered first end, such that the ratio of the distance (a) to the length (x) is approximately five to eight.

5. The string instrument as in claim 4, wherein the chamfered first end of the bass bar is located proximate a central longitudinal axis of the top plate and at a distance (b) from an upper end of the top plate, such that the ratio of the distance (b) to the length (y) of the body is approximately three to fourteen.

6. The string instrument as in claim 5, wherein the bass bar extends from the chamfered first end at an angle (θ) relative to the central longitudinal axis of the body, such that the bass bar is separated from one of the two f-holes by a distance (c), wherein the ratio of the length (x) of the bass bar to the distance (c) is approximately one to sixty-four.

7. The string instrument as in claim 6, wherein the string instrument is a violin, wherein:

the length (y) of the body is approximately 14 inches;

the length (x) of the bass bar is approximately 8 inches; and the distance (a) is approximately 5 inches, the distance (b) is approximately 3 inches, and the distance (c) is approximately ⅛ inch.

8. The string instrument as in claim 7, wherein the top plate and the back plate each comprises an upper bout having a thickness of approximately 2 to 2.5 millimeters, a lower bout having a thickness of approximately 2 to 2.5 millimeters, and a waist having a thickness of approximately 3 to 3.5 millimeters.

9. A string instrument with superior tonal qualities, comprising:

a body having an air cavity defined by a top plate, a back plate, and one or more ribs, the top plate and back plate being distanced from one another by the one or more ribs, the body having a length (y);

two f-holes defined by f-shaped cuts in the top plate;

a neck attached to an upper end of the body, the neck extending away from the body and having a fingerboard thereon;

a tailpiece attached to a lower end of the body;

a plurality of strings coupled between the tailpiece and a distal end of the neck;

a bridge attached to the top plate between the two f-holes, the bridge configured to support the plurality of strings above the fingerboard; and a bass bar secured to a back side of the top plate, the bass bar comprising a length (x), wherein the ratio of the length (x) of the bass bar to the length (y) of the body is approximately four to seven, the bass bar comprising a plurality of laminates secured to one another in a single layup then cut to form the bass bar, the plurality of laminates being cut from western red cedar, such that each laminate has a grain direction substantially parallel to a longitudinal axis of the single layup, each laminate of the plurality of laminates comprising a thickness of approximately 0.075 inch, a width of approximately one inch, and a length approximately 2 inches greater than the length (x) of the bass bar.

10. The string instrument as in claim 9, wherein the bass bar further comprises a first end and a second end opposite the first end along the length (x), the first end of the bass bar being located proximate a central longitudinal axis of the top plate and at a distance (b) from an upper end of the top plate, such that the ratio of the distance (b) to the length (y) of the body is approximately three to fourteen.

11. The string instrument as in claim 10, wherein the bass bar extends from the first end at an angle (θ) relative to the central longitudinal axis of the body, such that the bass bar is separated from one of the two f-holes by a distance (c), wherein the ratio of the length (x) of the bass bar to the distance (c) is approximately one to sixty-four.

12. The string instrument as in claim 11, wherein the bass bar further comprises:

a width, wherein the ratio of the width to the length (x) is approximately one to thirty-two;

a chamfered first end, the bass bar having a first height proximate the chamfered first end;

a chamfered second end opposite the first end along the length (x), the bass bar having a second height proximate the chamfered second end, the second height being substantially equal to the first height;

a tapered height profile along the length (x), wherein the bass bar has a maximum height (h) at a distance (a) from the chamfered first end, such that the ratio of the distance (a) to the length (x) is approximately five to eight, the ratio of the maximum height (h) to the length (x) is approximately three to sixty-four, and the ratio of the first height to the maximum height (h) is approximately one to two.

13. The string instrument as in claim 12, wherein the string instrument is a violin, wherein:

the length (y) of the body is approximately 14 inches;

the length (x) of the bass bar is approximately 8 inches;

the distance (a) is approximately 5 inches, the distance (b) is approximately 3 inches, and the distance (c) is approximately ⅛ inch; and the top plate and the back plate each comprises an upper bout having a thickness of approximately 2 to 2.5 millimeters, a lower bout having a thickness of approximately 2 to 2.5 millimeters, and a waist having a thickness of approximately 3 to 3.5 millimeters.

14. A method of constructing a bass bar for a string instrument, comprising:

calculating a length (x), wherein the ratio of the length (x) to a length (y) of the string instrument is approximately four to seven;

cutting a plurality of laminates from western red cedar, such that each laminate has a grain direction substantially parallel to a longitudinal axis of each laminate;

preparing a layup of the plurality of laminates by pressing the plurality of laminates together with a layer of adhesive between each respective laminate;

cutting a bass bar profile from the layup to produce a bass bar cutout; and sanding the bass bar cutout to produce a completed bass bar, the completed bass bar comprising:

a length approximately equal to the length (x);

a lower edge along the length of the bass bar, the lower edge being configured to conform with an inside surface of the string instrument;

a chamfered first end;

a chamfered second end opposite the chamfered first end;

a first height proximate the chamfered first end;

a second height proximate the chamfered second end, the second height being approximately equal to the first height; and a maximum height (h) at a distance (a) from the chamfered first end, wherein the ratio of the distance (a) to the length (x) is approximately five to eight.

15. The method as in claim 14, wherein the ratio of maximum height (h) to the length (x) is approximately three to sixty-four, the ratio of the first height to the maximum height (h) is approximately one to two, and the ratio of a width of the bass bar to the length (x) is approximately one to thirty-two.

16. The method as in claim 14, further comprising:

securing the bass bar to the inside surface of the string instrument, wherein:

the chamfered first end is located proximate a central longitudinal axis of the string instrument at a distance (b) from an upper end of the string instrument, such that the ratio of the distance (b) to the length (y) of the string instrument is approximately three to fourteen; and the bass bar extends from the chamfered first end at an angle (θ) relative to the central longitudinal axis of the string instrument, such that the bass bar is separated from an f-hole of the string instrument by a distance (c), wherein the ratio of the length (x) to the distance (c) is approximately one to sixty-four.

17. The method as in claim 16, wherein the string instrument is a violin having a length (y) of approximately 14 inches, such that the length (x) is approximately 8 inches, the distance (a) is approximately 5 inches, the distance (b) is approximately 3 inches, and the distance (c) is approximately ⅛ inch.

* * * * *